US009470455B2

(12) United States Patent
Stanish

(10) Patent No.: US 9,470,455 B2
(45) Date of Patent: Oct. 18, 2016

(54) SORTING GREEN LUMBER

(71) Applicant: WEYERHAEUSER NR COMPANY, Federal Way, WA (US)

(72) Inventor: Mark A. Stanish, Seattle, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 75 days.

(21) Appl. No.: 14/456,238

(22) Filed: Aug. 11, 2014

(65) Prior Publication Data

US 2016/0040933 A1 Feb. 11, 2016

(51) Int. Cl.
*F26B 21/08* (2006.01)
*F26B 25/22* (2006.01)

(52) U.S. Cl.
CPC ..... *F26B 25/22* (2013.01); *F26B 21/08* (2013.01); *F26B 25/225* (2013.01); *F26B 2210/16* (2013.01)

(58) Field of Classification Search
CPC ..... F26B 5/00; F26B 21/00; F26B 21/06; F26B 21/08; F26B 25/00; F26B 25/22; D21H 7/00; D21H 7/04; D21H 17/00; D21H 17/33; C07G 1/00; C09K 21/00; C09K 21/06; B30B 9/00; B30B 9/20
USPC ..... 34/396, 413, 486, 528, 202; 162/164.1; 428/221, 412; 100/37, 102, 153
See application file for complete search history.

(56) References Cited

U.S. PATENT DOCUMENTS 1,562,764 A * 11/1925 Harris ..... F26B 9/06 34/229
3,900,957 A * 8/1975 Denton ..... F26B 25/185 156/235
5,815,945 A * 10/1998 Ando ..... F26B 3/305 34/212
5,836,086 A * 11/1998 Elder ..... F26B 3/04 34/396
6,219,937 B1 * 4/2001 Culp ..... F26B 21/004 34/218
6,467,190 B2 * 10/2002 Nagel ..... F26B 21/026 34/218
8,714,467 B2 * 5/2014 Lucas ..... B02C 13/00 241/188.1
8,726,539 B2 * 5/2014 Potter ..... F26B 9/02 165/54
8,832,964 B2 * 9/2014 Foxen ..... C09F 3/00 144/364
9,127,882 B2 * 9/2015 Jenkins ..... D06F 58/28
9,328,211 B2 * 5/2016 Nemoto ..... C08B 15/04
2009/0206507 A1 * 8/2009 Martin ..... B29B 9/065 264/141
2010/0101108 A1 * 4/2010 Haas ..... B07B 13/18 34/381
2014/0124354 A1 * 5/2014 Pagnozzi ..... B27K 5/0075 201/35
2015/0159105 A1 * 6/2015 Sethi ..... C10B 49/10 44/590
2015/0217530 A1 * 8/2015 Sobota ..... F26B 17/04 100/37
2016/0040933 A1 * 2/2016 Stanish ..... F26B 25/22 34/427

FOREIGN PATENT DOCUMENTS

EP 1801581 A1 * 6/2007 ..... G01N 33/46
EP 1975609 A1 * 10/2008 ..... G01B 21/30
JP 2007171196 A * 7/2007

* cited by examiner

*Primary Examiner* — Stephen M Gravini
(74) *Attorney, Agent, or Firm* — Perkins Coie LLP

(57) ABSTRACT

A method of sorting green lumber is based on a ratio of moisture content to either weight or density. The moisture content of each piece of green lumber is measured, and the weight or density of the green lumber is measure. One more thresholds of moisture content to weight or density ratios are used to divide the green lumber into groups. Such a sort tends to produce groups of green lumber that require similar kiln drying schedules.

7 Claims, 12 Drawing Sheets

SORTING GREEN LUMBER

BACKGROUND

The lumber mill industry has become largely automated. Full length tree trunks are delivered to lumber mills, where they are automatically debarked, and cut into log segments. These log segments are then typically processed at a number of automated stations, depending on the lumber mill and the type of wood. These processing stations produce lumber from each log segment. The resulting lumber is generally intended for use as building construction material, but is often used in any of a wide variety of applications, such as non-building construction, furniture, and decorative objects.

In general, the tree trunks that are delivered to saw mills typically have a high level of moisture content. As such, the resulting lumber is referred to as green lumber. Green lumber is usually dried or otherwise treated to reduce the moisture content level to produce lumber with improved strength, durability, and other attributes. Green logs or lumber can be dried, for example, by simply allowing the cut wood to sit in dry air for weeks or months, but most modern large-scale lumber production includes controlled drying of cut green lumber pieces in a kiln.

Lumber is often sold by size, and not fully differentiated by the species of the tree from which it was cut. For example, a Canadian softwood lumber product not fully differentiated by species is SPF, which includes a combination of spruce, pine, and fir. SPF from Eastern Canada may include, for example, red spruce, black spruce, jack pine, and balsam fir species. SPF from Western Canada may include, for example, white spruce, Engelmann spruce, lodgepole pine, and alpine fir.

BRIEF DESCRIPTION OF THE DRAWINGS

A more detailed understanding may be had from the following description, given by way of example in conjunction with the accompanying drawings wherein.

DETAILED DESCRIPTION OF ILLUSTRATIVE EMBODIMENTS

Converting trees into high quality lumber is an economically important enterprise. To that end, drying lumber, is one part of those processes that impact on quality. This disclosure presents techniques for drying green lumber, and in particular, for sorting cut green lumber before drying it in batches in a kiln. A goal is a drying process that is both efficient and produces a high quality product. Efficiency is achieved, in part, by a batch drying process where a large amount of green lumber is left in a large kiln for a single drying treatment. Quality is achieved, in part, by getting every piece of lumber in the batch close to a target moisture content at the end of the single drying treatment. Instead of putting all green lumber though the same drying process as is traditionally done, grouping green lumber pieces based on the amount of kiln drying time each piece needs can produce both a more efficient process and a higher quality result. Techniques for sorting green lumber into such groups for drying are presented here. In one embodiment, the weight or density of a piece of lumber is used in combination with the green moisture content to predict drying time and to sort pieces of lumber accordingly.

Many references to lumber in this disclosure refer to techniques that may also apply to other types of wood or wood products. In particular, the sorting and rating techniques described here may apply to other types of wood or wood products. As used herein, lumber is a broad term, referring to any piece of wood, including, for example, uncut, undebarked logs, partially processed logs, log segments, cants, sideboards, flitches, edging strips, boards, finished lumber, etc. The term, log, unless apparent from its context, is also used in a broad sense and may refer to, inter alia, uncut, undebarked logs, partially processed logs or log segments.

The headings and Abstract of the Disclosure provided herein are for convenience only and do not interpret the scope or meaning of the embodiments.

Lumber Production Overview

Figure 1A:
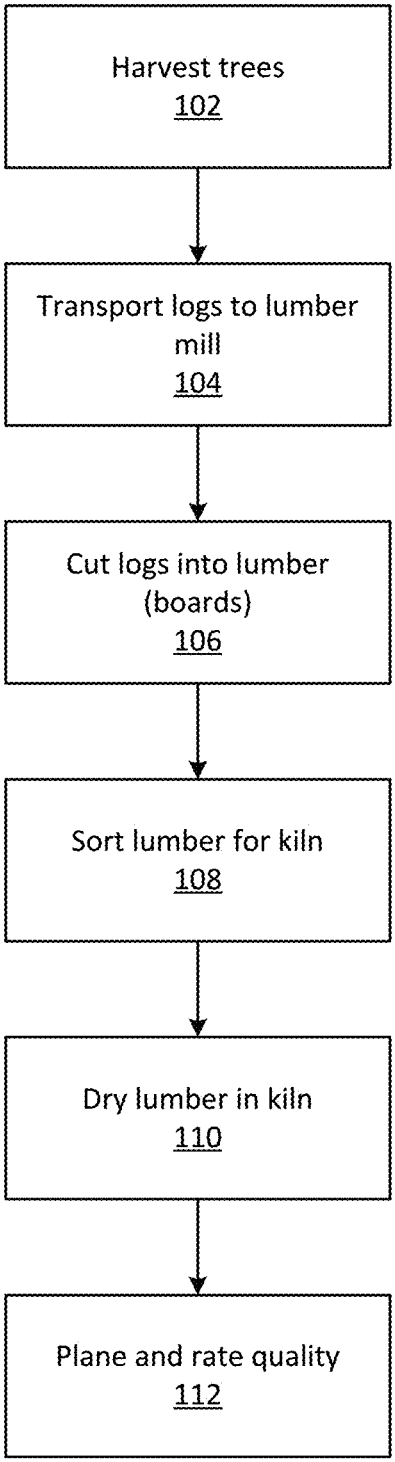
FIG. 1A is a flow chart depicting an overview of modern lumber production.

An overview of modern lumber production is depicted in FIG. 1A. The process starts by harvesting trees 102. These trees are usually alive when cut down, and their capillaries are filled with water moving from the roots of the tree up to the leaves or needles at the ends of the branches. The cut timber or logs are transported to a lumber mill 104, where the logs are cut into lumber 106. Example techniques for cutting logs into lumber are described below along with FIG. 1B. The result of cutting is typically boards of lumber in various shapes. The lumber at this point is sometimes referred to as "green lumber" because it has not yet been dried or otherwise seasoned as described below. Then the lumber may be sorted for drying in a kiln 108. The sorting may be based, for example, on a size of the boards, since, for example, thicker pieces of lumber typically require longer drying times. For various reasons such as efficiency, lumber is generally not dried in individual pieces. Example techniques for sorting lumber are described below along with FIGS. 6 and 7. Physically, the sort can be done with several bins that follow the systems for deciding how to sort. Each bin can correspond to the different sort categories available. For example, if sorting was based on 2 categories of lumber length, 4 categories of lumber width, and 3 categories of moisture content ratio, there might be $2\times4\times3=24$ bins. After a particular board is rated for a sort category, it can be placed into the bin corresponding to the sort category. Lumber collected in a single bin can then be loaded into a single kiln package and dried in a kiln 110.

An industrial sized kiln for drying lumber, often referred to as a lumber kiln, may be a freestanding building, requiring several trips of a forklift to fill the kiln. As such, the lumber kiln generally contains a very large batch of lumber of various sizes and species of wood that may have different properties. Yet, all the lumber in a single kiln charge is dried for the same amount of time, and with the same drying schedule (a drying schedule may include a temperature, drying process, and a duration for drying). After drying, the lumber is processed through a plane mill and each board is individually quality rated 112.

The lumber drying step 110 can be done with a simple heated kiln as described above where energy is applied to the wood in the form of heat, but any lumber drying system can be used. For example, simple air drying for weeks or months is not uncommon. Another example is a heated kiln with added humidification, the added humidification can sometimes better control the drying process. Another alternative is a dehumidification kiln that uses less energy. A solar kiln is yet another option that uses only the sun to add heat, but may require longer drying times than other alternatives. A kiln can also dry wood by applying non-heat energy to the wood, for example using microwave or radio-frequency (RF) energy.

The lumber drying step 110 may include seasoning in addition to, or instead of, drying. There are many types of lumber seasoning. For example, water seasoning involves immersion in running water to quickly remove sap, and then allow the lumber to air dry. Immersion in steam or submersion in boiling water will also speed drying. Seasoning by submersion in a solution of urea, sodium nitrate, or sodium chloride (salt), and then air drying is another option. Techniques described in this disclosure applicable to drying may also be applicable to seasoning. In particular, sorting lumber for batch seasoning may benefit from the sorting techniques described here.

Figure 1B:
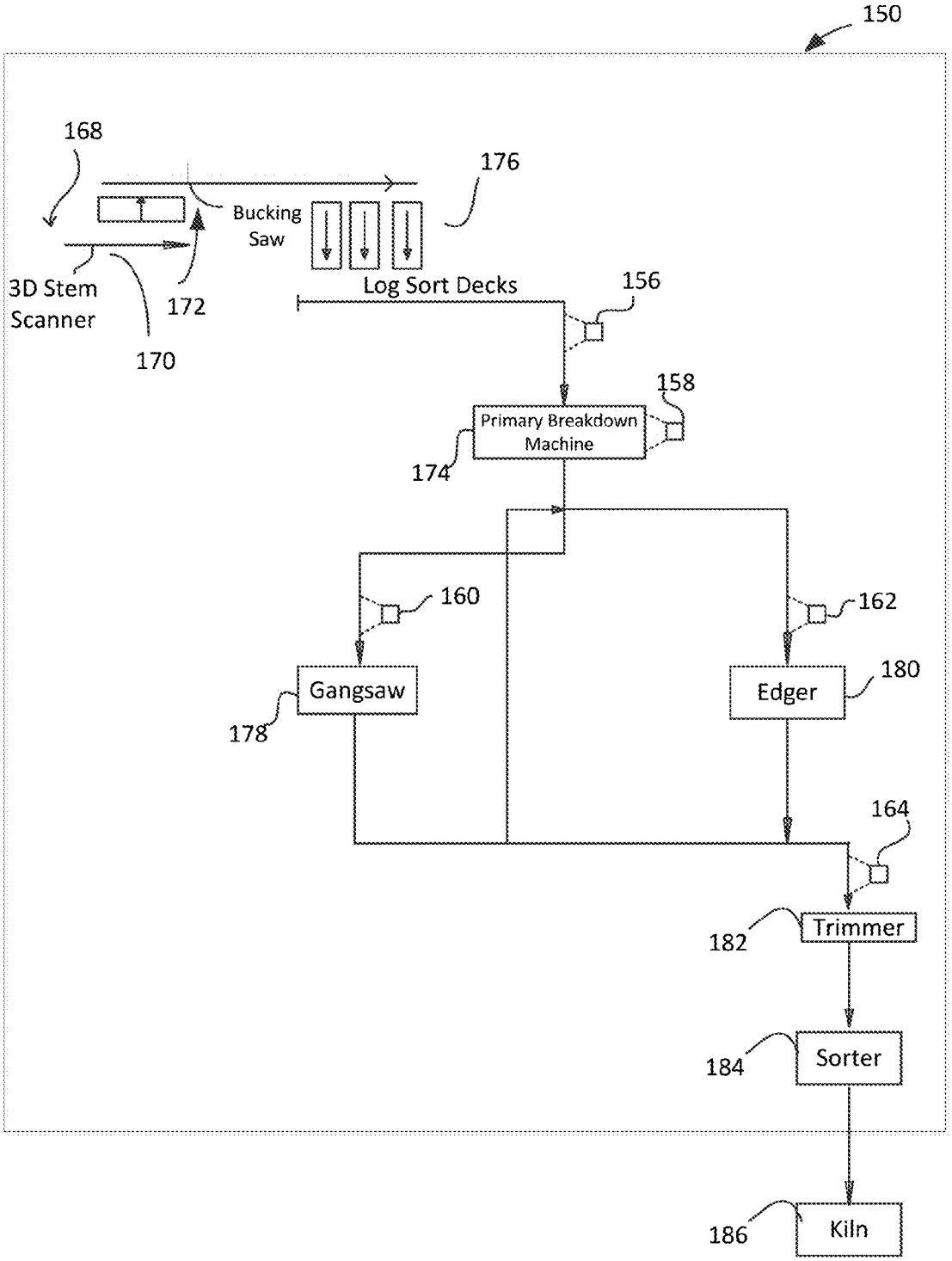
FIG. 1B is a schematic view of an example lumber mill system.

In short, there are many options for drying green lumber, and many of them may benefit from the sorting techniques disclosed here. Note that the processes described here with FIG. 1A and FIG. 1B are only an overview of a typical lumber production process. Aspects of the disclosed techniques are also applicable to other processes. For example, some of the steps could be eliminated or other steps added without departing from the spirit of the disclosure.

FIG. 1B depicts a lumber mill system 150 and is an example system for implementing the step for cutting logs into lumber 156 of FIG. 1A. The lumber mill system 150 includes one or more bucking saws 172, log sort decks 176, a primary breakdown machinery 174, a gangsaw/resaw 178, an edger 180, a trimmer 182, a sorter 184, and one or more scan zones 156,158, 160, 162, and/or 164 where acquisition devices (e.g., laser scanners, imagers such as camera) are installed.

While omitted from FIG. 1B, it is recognized that the lumber mill system 150 may include one or more optimizers in conjunction with one or more pieces of equipment (e.g., the bucking saws 172, the primary breakdown machinery 174, the gangsaw/resaws 178, the edger 180, and/or the trimmer 160). The optimizers analyze information about the input (e.g., log segments, cants, boards) of a set of operations (e.g., sawing), and automatically determine a number of parameters intended to optimize the operations, for example, to produce an optimized output. The optimizers typically include the one or more acquisition devices to acquire information from logs, cants or boards, and one or more computers programmed to process and/or analyze the acquired information and produce an optimized solution that is intended to optimize an output of the operation(s).

As illustrated in FIG. 1B, the lumber mill system 150 receives full length tree trunks at 168. These full length tree trunks or logs may be debarked and then scanned at a 3D stem scanner 170. The 3D stem scanner 170 may be implemented as one or a plurality of planar laser scanners that generate image data along the length of each log. The image data for the logs may then be analyzed by a computer optimizer (not shown) in order to determine how best to saw or "buck up" the logs into log segments.

This process of deciding how to buck up a log into log segments is called merchandizing. In one embodiment, the computer optimizer performing the merchandizing uses a brute force simulation of all possible bucking options, simulating in addition all of the downstream sawing processes that will take place inside the lumber mill system 150 (e.g., primary breakdown, cant processing, and edging). The merchandizing computer optimizer may also take into account the processing time for each individual log segment, the current market values for particular pieces of lumber, the effect of log sweep (or curvature) on recovery, etc.

After the merchandizing computer optimizer has determined how to buck up a particular log, the log may then be driven transversely or lineally through the one or more bucking saws 172 so as to be bucked up into log segments. The bucking saws 172 may be controlled by a programmable logic controller (PLC) or other automated system, which may in turn be controlled by the merchandizing computer optimizer.

After the bucking process, the log segments may be sorted, for example, by species, size and intended end use, at the log sort decks 176 prior to further processing. Then, the log segments may be transported to the primary breakdown machinery 174. Upstream from the primary breakdown machinery 174, the log segments may be scanned at a log segment scan zone 106. The primary breakdown machinery 174 processes the log segments to produce cants and may include chip heads for removing slab wood as well as one or more saws (e.g. round saws or band saws) for sawing sideboards from the cants. A primary breakdown scan zone 158 may be positioned to generate image data of a saw blade and sideboards sawn from the log segments.

After processing at the primary breakdown machinery 174, the cants may be transported for further processing at the gangsaw/resaw 178. In some embodiments, a gangsaw may be used to break down the cants. In other embodiments, other machines may be used to cut the cants. For example, series band saws, commonly known as "resaws," may be used. Such resaws may saw one or more boards at a time from the cants. In order to scan boards, a gangsaw/resaw scan zone 160 may by positioned at or further from the outfeed of the gangsaw/resaw 178.

The boards from the gangsaw or resaws and the sideboards from the primary breakdown machinery 174 may be further processed by the edger 180. The edger 180 may be associated with another scanning and optimization system and may include one or more movable saws for sawing along the length of each board. An edger scan zone 162 may be positioned downstream from the edger 180 to scan an edged board as well as edging strips.

After processing at the edger 180, the boards may be transported to the trimmer 182, where they may be trimmed to their final length for distribution as finished lumber. The trimmer 180 may be associated with yet another optimization system and may include one or more saws for trimming the boards. A trimmer scan zone 164 may be positioned downstream from the trimmer 182 to scan pieces of lumber. After processing at the trimmer 182, the pieces of lumber may be transported to a sorter 184. Sorter 184 may sort lumber for various reasons, including sorting for quality, sorting by species, sorting for size, and sorting for groups of lumber to be dried together in a kiln 186. After cutting logs have been cut into lumber and sorted with the lumber mill system 150, the kiln 186 may be used to dry the lumber.

Drying Green Lumber

There are several reasons to dry lumber before use, for example, as a construction material. Lumber generally shrinks and may warp, crack, or split as it dries. Drying beforehand reduces the amount a board will shrink during use in construction of a more complex structure. In addition to reduced shrinkage and warpage, lumber strength increases when properly dried. Drying timber helps prevent decay, staining from fungus, and infestation by insects. Dried lumber is also lighter which reduces transportation costs, and dried lumber has better electrical and thermal insulation properties. There are uses for green (undried) lumber, such as where the purchaser intends to bend the lumber, forcing it into a particular shape. Even in that case, the lumber is also generally dried after being shaped.

Drying lumber can be complicated, at least in part, because lumber contain two types of water, free water and bound water, and because wood is hygroscopic. The wood of a freshly cut tree contains lots of water, due mostly to the process of water moving up continuously from the roots to the leaves of a tree. A continuous capillary action pulls water and nutrients from the ground through the tissues of the truck of a tree up to smaller branches and out to the leaves or needles. This water moves through the trunk and branches in cellular lumina, which are small tubes where the surface tension of the water creates the capillary action to pull the water up. Water in the lumina is called free water and is not bound chemically to the tree cells. Wood also has bound or hygroscopic water, which is water absorbed from the air around the tree. Bound water has a chemical bond with the wood cells, and is dependent on the humidity of the air around the tree. Both free water and bound water are removed as green lumber is dried.

The general target for drying lumber is to match the water vapor level inside the lumber with the water vapor level of the lumber's intended final environment. Wood is hygroscopic in nature, which means that wood acts something like a sponge and balances the amount of water contained in it with the amount of water in the environment around it. Wood gives water off, or absorbs water from, the surrounding air until an equilibrium is reached where the vapor pressure inside and outside the wood is equal. After reaching equilibrium, a piece of wood will continue to absorb and give off water as the ambient humidity and temperature change. However, a freshly cut tree has a very high moisture content in comparison to the air around it due in part to all the free water held in place by the capillary action sucking water up from the ground. Therefore, the largest change in wood moisture content to achieve equilibrium is generally just after a live tree is cut down.

When enough water volume is removed from green wood, the volume of the wood itself shrinks. After the free water has evaporated from the capillaries in the wood, the remaining water to be removed is the water bound in the wood cells. As the bound water is removed, the wood cells shrink, and the wood overall shrinks. The biggest change in wood size occurs generally during the initial drying. The target moisture of lumber after drying is usually the level expected in the final environment of use. By matching the ambient environment, the shrinkage (or swelling) caused by seeking equilibrium with the environment is reduced after the lumber is placed in its final environment.

Shrinking generally occurs at different rates in different direction within the lumber. Longitudinal (along the wood grain) shrinkage is usually small, perhaps just 0.1% to 0.3%. Tangential (tangent to the growth rings) shrink may be in the range 5% to 10%, while radial (perpendicular to the growth rings) shrinkage may be 2% to 6%. This non-uniformity in shrinkage, along with irregularities in the lumber, such as changes in grain direction due to branches emanating from a tree trunk, make shrinkage somewhat unpredictable and best done prior to rating lumber quality for sale.

Lumber Moisture Content

Moisture content (mc) in lumber is usually specified as a percentage number, and is defined such that 100% moisture content is, by definition, the point where lumber is 50% water and 50% other substance by weight. The equation usually used to determine lumber moisture content is $$\text{Moisture content} = \frac{m_g - m_{od}}{m_{od}} \times 100$$

where $m_g$ is the mass of lumber being measured (mass of the green lumber), and $m_{od}$ is oven dried mass of the lumber. The green mass may be generally a simple weight measurement before drying. The oven dried mass is mass of the lumber after completely drying the lumber. This is not an ordinary percentage measurement in that lumber moisture content can be above 100% mc. A piece of lumber that is half water by weight will therefore be considered to have 100% mc; a piece of lumber that is three-quarters water by weight will be considered to have 300% mc; and a piece of lumber that is one-quarter water by weight will be considered to have 33⅓% mc.

In practice, the moisture content of freshly cut lumber can vary greatly, for example from under 30% to over 160% mc for green lumber from a single geographic region in Western Canada. Several factors affect the moisture content of green lumber when it first arrives at a lumber mill for processing. For example, moisture content can vary by species of source tree or the microclimate in which the source tree grew. Disease or infestation can also affect moisture content. If a tree was dead long before being cut down, the drying process may have started before arrival at the lumber mill. A common example of this in Western Canada is trees killed by beetle infestations.

Moisture content is also influenced which portion of a log that a particular board is cut from. Sapwood is the outer, newest seasonal growth rings of a tree and is where the largest amount of water traverses up a tree to the leaves. Heartwood is the older, inner portion of a tree, and pith-wood is the very center of a tree. Sapwood boards generally have higher moisture content than heartwood or pith-wood boards from the same tree.

Moisture content in lumber can be estimated with a variety of measurement techniques. A generally accepted standard was defined by the American Society of Testing and Materials (ASTM) in 1968, and involves first weighing the sample of the lumber in question to determine $m_g$. Then the same sample is put into an oven to dry until there is no moisture content left in the sample. According to the standard, the oven should be at 103° C.±2° C. (above the boiling point for water) for 24 hours, and then the weight is re-sampled at 2-hour intervals until there is no further weight loss. The final weight after drying is $m_{od}$. Now the moisture content of that sample can be determined using the above equation. In addition to taking a long time (over a day) to measure moisture content with this standard method, another notable downside of the method is that the sample of lumber is effectively ruined for most uses by over-drying.

Faster and less destructive methods for estimating lumber moisture content are known. Electric lumber moisture measurements, for example, include an electrical resistance (or conductance) measurement, or dielectric type measurements. Electrical resistance of a piece of lumber is directly related to the moisture content of the lumber (and conversely, electrical conductance of lumber is indirectly related to the moisture content). An ordinary ohmmeter (electrical resistance meter) capable of measuring high levels of resistance (over 10 megaohms), with probes that directly contact the lumber being measured, produces a measure of resistance (or conductance) that relates to moisture content. Dielectric type measurements include both a power-loss type measurement, and a capacitance type measurement. With a power-loss type measurement, the moisture content of the lumber is related to a measured dielectric loss factor of the lumber. With a capacitance type measurement, the moisture content of a piece of lumber is related to the measured dielectric constant of the lumber.

Simple measurements of lumber moisture content can be improved upon by compensating for some variability in the measurement process. For example, Northern Milltech Inc. (NMI) produces industrial lumber moisture content measurement devices that use high-speed electrical pulses for a dielectric type measurement of the moisture content. Some NMI devices also include a laser-based movement sensor and infrared temperature sensor to for additional accuracy. The lumber temperature, in addition to moisture content, may affect the electrical resistance or dielectric measurement. The additional sensors are combined to create a more accurate electric moisture content measurement of the lumber. Many lumber moisture content measurement products are available commercially, for example from (or marketed under the brand names of) SCS Forest Products, Delhorst, Tramex, Comprotec, General Tools & Instruments, and Lignomat.

The goal when drying lumber is not usually to eliminate all water from the lumber (in contrast to the moisture content measurement process described above). Because lumber is hygroscopic, the target is a moisture content level that matches the environment of expected final usage. Final use in an indoor air conditioned environment might have moisture content 6% to 7% mc, while muggy warm outdoor environments can be above 15%-18% mc. Typically, however, the actual final usage environment is not known when drying lumber, and a target 10% to 15% mc level is often considered ideal.

Sorting Factors

The amount of time required to achieve a target moisture content is widely variable for a piece of green lumber in a kiln. Causes for the variation in drying time are not fully understood. Though several factors effecting drying time are known, their interaction is also not fully understood. For a particular piece of lumber, some of these factors include lumber size, species of tree the from which the lumber is cut, where within a tree the particular piece is cut from (pith-wood, heartwood, or sapwood), green moisture content, and specific gravity. The effect of the first factor, size, is that the larger a piece of lumber, the longer it will take to dry. Water near the surface of a piece of lumber evaporates first, while water near the center of a piece of lumber evaporates more slowly. A larger piece of lumber will take longer for the heat in an oven or kiln to penetrate, and longer for the water stored in the center of the lumber to exit all the way to the surface of the lumber. For the second factor, different lumber species have different anatomical and mechanical properties that may cause differences in drying time or speed. The effect of the third factors, sapwood, heartwood, or pith-wood, is that sapwood typically requires the longest drying time, while pith-wood requires the least. Perhaps most obviously, the effect of the fourth factor is that the higher the moisture content, the greater the amount of water that must be removed, and hence the greater the drying time to achieve a target moisture content. Sorting by any of these factors as a predictor of drying time may save production costs and/or improve quality of the resultant lumber, but there are still problems.

Sorting by size is common. Larger pieces tend to take longer to dry. For example, all 2×4s may be dried together, and all 2×6s are dried separately. Lumber responds differently along the grain than it does transverse to the grain (radially and tangent to the growth rings), so sorting by transverse size without regard to length along the grain can be effective. For example, 2×4s of different lengths are often sorted and dried together, while 4×4s are often sorted and dried separately from the 2×4s.

Sorting by species is both hard to do, and does not sufficiently narrow the drying time range. Trees of different species can grow nearby each other, and different species can arrive at a lumber mill mixed together, and sorting them prior to sawing into pieces is awkward. As mentioned above, groups of species that grow together are marketed together in some cases. Such is the case with SPF (spruce, pine, and fir) lumber, where the species need not be sorted prior to sale.

The main problem with sorting based on species is that while average drying time varies between species, the range of drying times for each species can have a large overlap. For example, in one study with SPF from Eastern Canada, spruce has a median moisture content of 50% mc, pine has a median 60% mc, and fir has a median of 90% mc. However, the ranges were wide and overlapped. Spruce varied from 28% to 114% mc, pine varied from 38% to 165% mc, and fir ranged from 74% to 140% mc.

Sorting to separate heartwood from sapwood is surprisingly ineffective for separating drying times. The moisture content of heartwood and sapwood can be very different, with sapwood having higher median moisture content. However, the drying rates of heartwood and sapwood also vary, and vary in a way that counteracts the difference in moisture content. That is the high moisture content sapwood tends to dry faster than the lower moisture content heartwood. The result is that difference in moisture content is offset by the difference in drying speed.

Sorting by moisture content is perhaps the most obvious factor to sort by, given the stated goal of achieving a uniform target moisture content for all the lumber loaded in a single charge in a kiln. Sorting by moisture content, as measured by devices such as those from NMI discussed above, are already in use in some commercial lumber drying processes. After cutting logs into boards of lumber, each board is has a moisture content measurement taken. A sort can be done, for example, by putting boards that are below a low threshold moisture content measure into a "dry" sort group; boards that are above a high threshold moisture content measure are put in a "wet" sort group; and board falling between the high and low thresholds are put in a "medium" sort group.

Example threshold values of NMI meter readings are 28 for the low threshold and 48 for the high threshold. Variations on this example sort include having just one threshold that creates just two sort groups, or having more than two thresholds to create more than three sort groups.

The benefits of sorting by green moisture content have been seen in commercial use. Benefits have been in the range of $15-$20 per 1000 board-feet (MBF). A large part of this benefit was attributed to beetle-killed trees. The benefits have also been characterized as 10% from energy savings, and 90% from improved quality of the dried lumber (less under-dried and less over-dried).

Figure 2A:
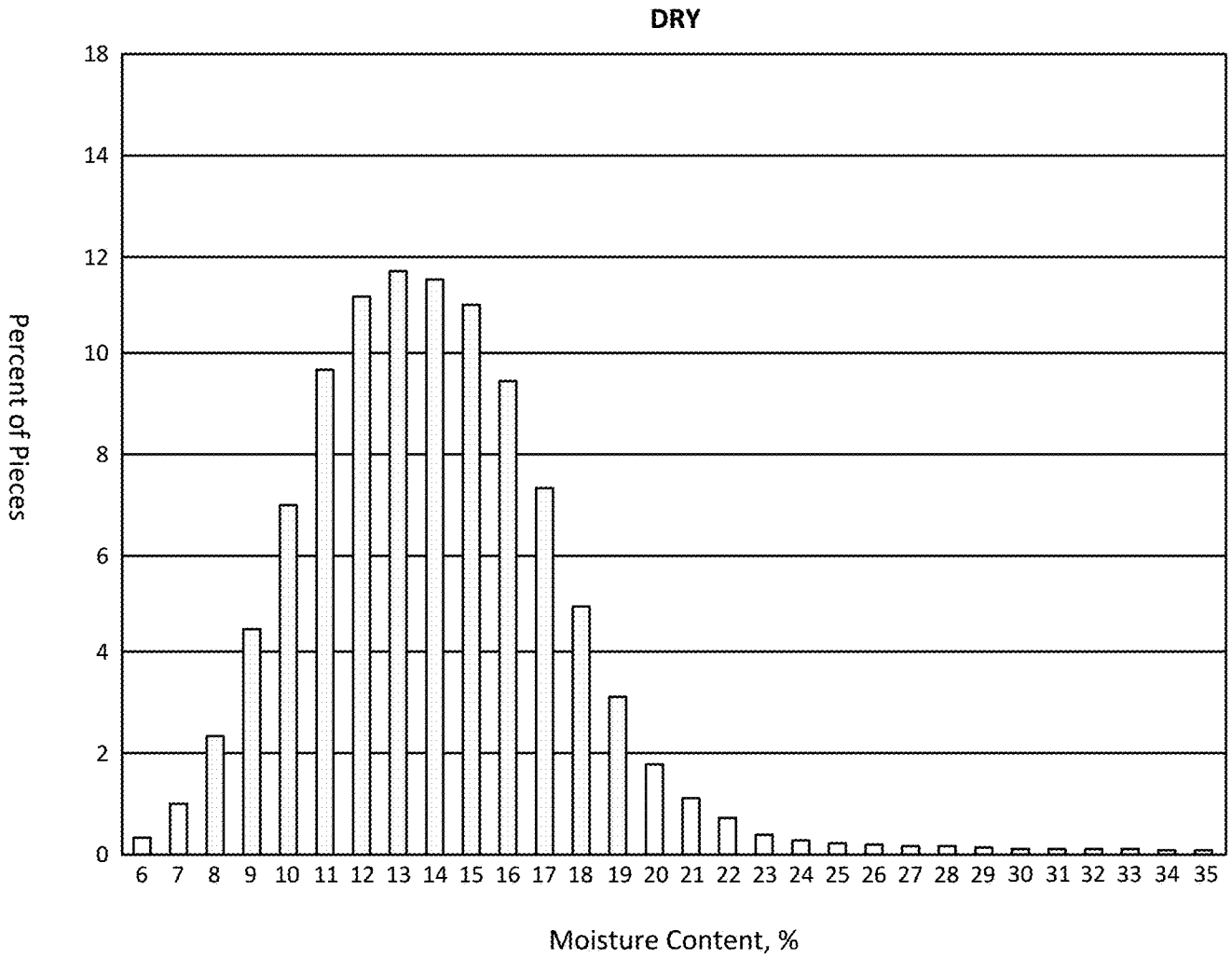
FIG. 2A is a graph depicting the distribution of moisture content after drying of the dry sort category, where sort is based only on moisture content.
Figure 2B:
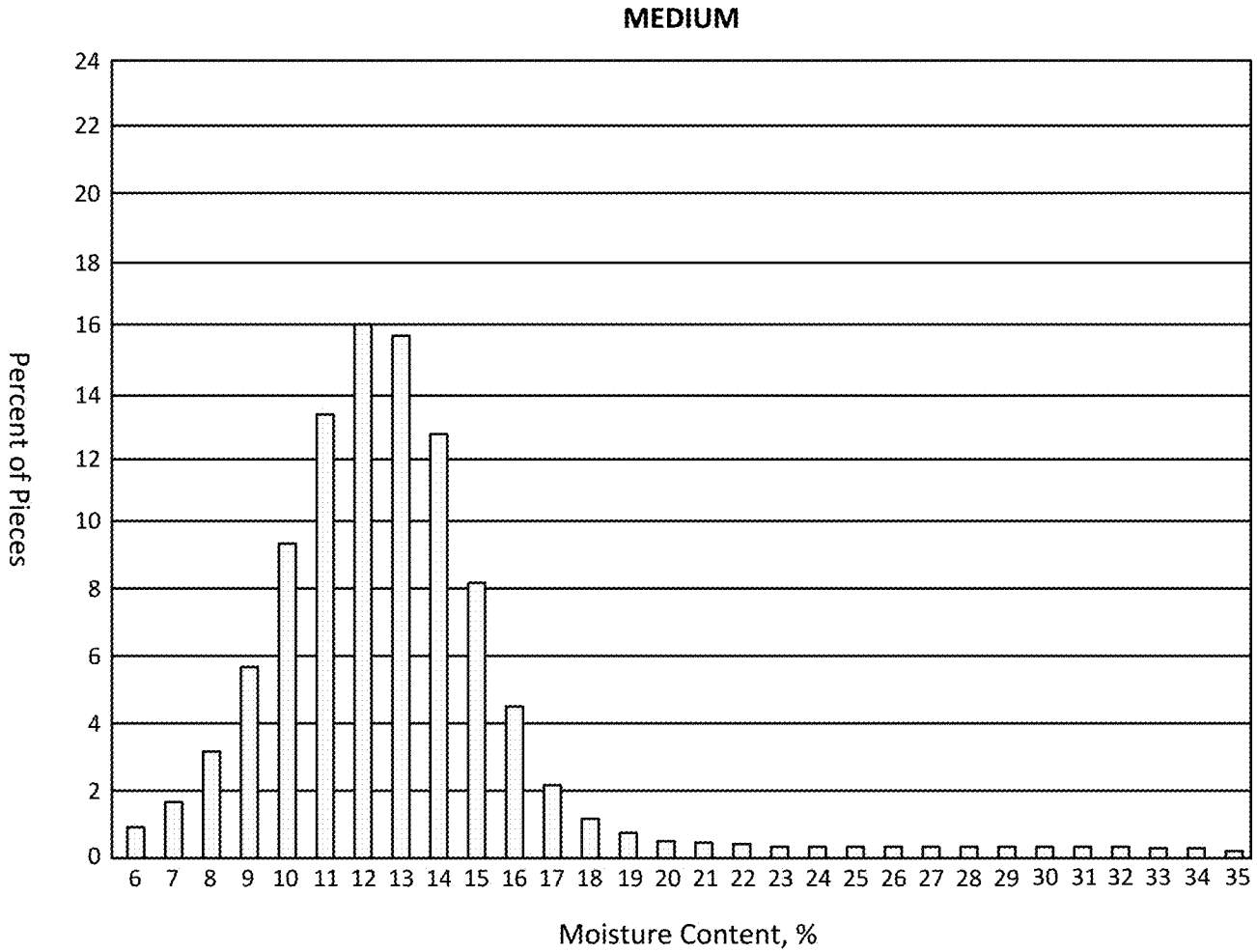
FIG. 2B is a graph depicting the distribution of moisture content after drying of the medium sort category, where sort is based only on moisture content.
Figure 2C:
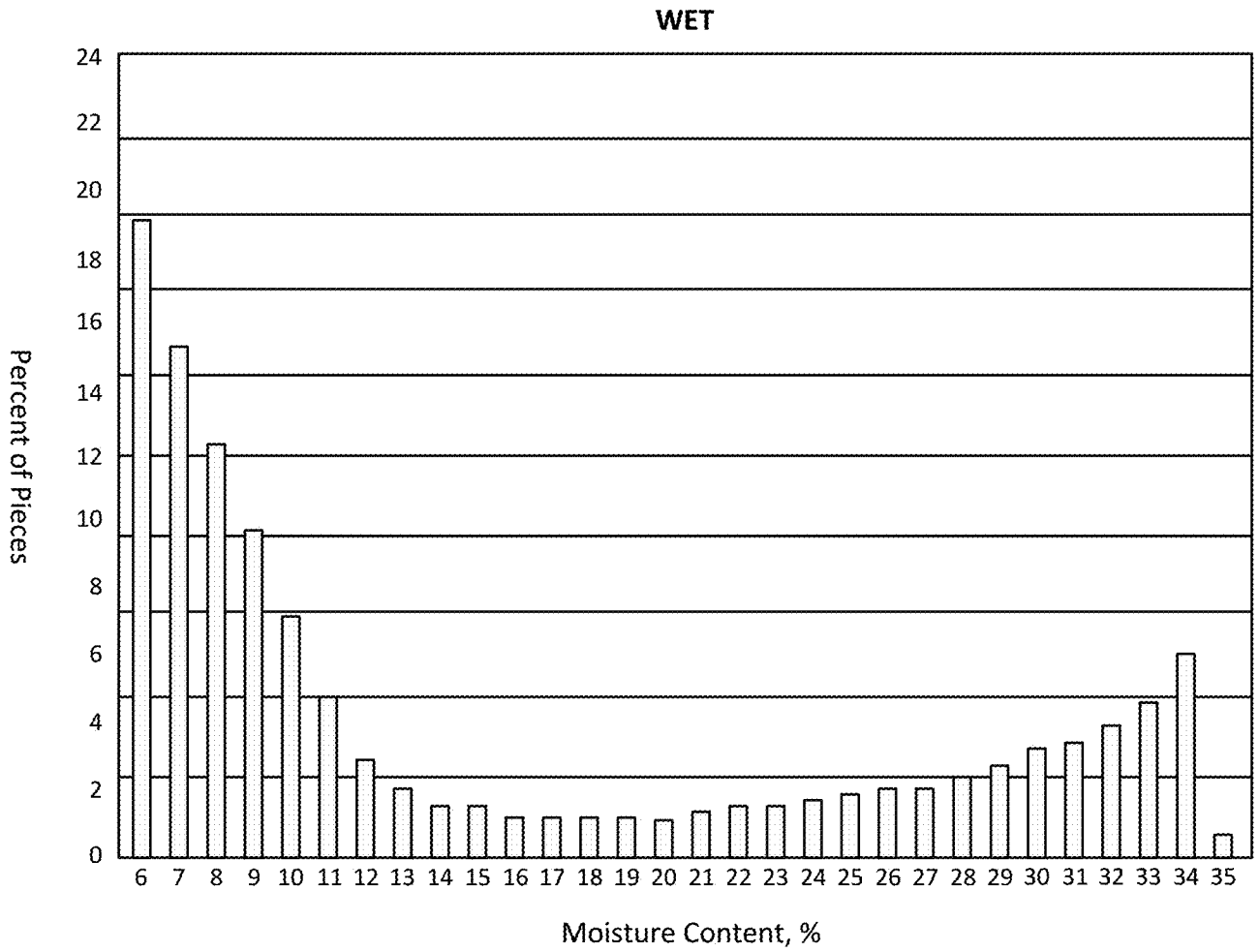
FIG. 2C is a graph depicting the distribution of moisture content after drying of the wet sort category, where sort is based only on moisture content.

Quality problems still occur with moisture content-based sorts. The results of one study done with Canadian SPF lumber is depicted in FIGS. 2A, 2B and 2C. Sixteen-foot long 2×4 boards were sorted into three categories by moisture content (wet, medium, and dry) using an NMI moisture meter. The NMI moisture meter used had eight sensing heads and did a transverse measurement (measured the boards while they are moving sideways). An average of the multiple measurements were used to categorize each board. Wet boards were above the high threshold; dry boards were below the low threshold; and medium boards were between the high and low thresholds. After sorting, all boards were dried in a kiln. Wet category boards dried the longest; dry category boards dried for the shortest time. Moisture content was again measured after drying, and the results are in FIGS. 2A, 2B, and 2C. FIG. 2A shows the distribution of final moisture content for the dry sort category. FIG. 2B shows the same for the medium sort category, and FIG. 2C for the wet sort category. The target moisture content was the range of 10% 15% mc. From FIGS. 2A and 2B we see a few boards were above and below the target moisture content, but most were within the target. However, in the wet sort of FIG. 2C, there is a fairly bimodal distribution with many board below 10% mc and many above even 25% mc. A substantial majority of the wet sort category was outside the target moisture content level of 10% to 15% mc.

This simple sort based on board size and an NMI meter moisture content measurement was helpful for the dry and medium sort categories, but was insufficient for the wet sorted category. Other studies have shown that increased green moisture content correlates with increased required drying time, but that this correlation varies with species. There is evidence that moisture content, or the amount of water that needs to be removed from lumber (at least as measured by current moisture meters), is not the only determining factor in how long a green board must spend in a kiln to achieve a target moisture content. Unfortunately, it remains unknown what all the factors are that effect kiln time, and the relationship between the known factors is unclear.

Moisture Content Ratio with Weight or Density

A new effective sorting factor for lumber combines weight or density with moisture content. One embodiment includes sorting green lumber based on a ratio of a moisture content measure to a weight measure. This includes, for example, a moisture content measure divided by a weight measure such as grams (g), which will be labeled herein as mc/g. Another embodiment includes sorting based on a ratio of a moisture content measure to a density measure, such as specific gravity measured in grams per cubic centimeter (g/cc). This includes, for example, a moisture content measure divided by a density measure, which will be labeled mc/(g/cc) herein. In other embodiments, the ratio can be inverted to g/mc and (g/cc)/mc. Sorting can be done based any of these ratios, and collectively these ratios, mc/g, g/mc, mc/(g/cc), and (g/cc)/mc, will be called moisture content ratios or mc ratios herein. Note that for simplicity several embodiments are described herein using an mc/g ratio, but these embodiments can be easily modified to use any of the moisture content ratios. A weight-based mc ratio is easily used because weight is an easy direct measurement to obtain, while a density-based mc ratio helps to normalizing across different sized pieces of lumber. If the lumber being sorted is all of roughly the same size, for example all 16' 2×4s, a weight-based mc ratio may be sufficient.

Moisture content, weight, and density can be all be measured in many ways. Any moisture content estimation or measure can be used to calculate a mc ratio, such an NMI meter or others described above. Weight can be measured with any weight or mass measurement system. This can include, for example, using a scale to weigh the combination of a piece of lumber sitting on a lug for automated movement of the lumber through a lumber mill, and then subtracting the weight (or an estimate of the weight) of the lug. Density can be measured using any know method, including use of a measured weight and measured or estimated volume. An estimated volume can be based, for example, on an expected volume of a 16' 2×4 without carefully measuring the volume of any particular board, and then using that volume estimate with an actual measured weight for each board. Other methods of measuring density include, for example, using Archimedes principle, measurement with gamma rays, measurement with x-rays, measurement with microwaves.

A moisture content ratio can be used to sort green lumber for drying as described below, but it also has many other applications. It may be useful to more generally rate green lumber for other purposes. In addition, it can be used to rate wood products other than lumber, including timber, pulpwood, sawdust, plywood, and wood pellets. It can also be used to sort or rate lumber or other wood products that are not green. For example, it can be used for quality control after drying of lumber or other wood products. It can also be used to help determine the species of a piece of wood.

Green lumber can be sorted using a moisture content ratio, for example using thresholds. By establishing one or more thresholds of a chosen moisture content ratio, green lumber can be sorted into two or more categories. With a single threshold, pieces of lumber can divided into two categories, such that boards with an mc ratio above the threshold are kiln dried for a certain time, with a certain drying schedule, or using a certain drying process. Boards with an mc ratio below that threshold are dried with an alternate drying time, drying schedule, or drying process. An automated system for sorting might include a moisture content measuring device, a weight or density measurement device, and a device capable of receiving the measurements and calculating a moisture content ratio. Such an automated system can be further used to direct a lumber transportation device such that the lumber is physically moved into separate groups based on each pieces moisture content ratio.

The mc ratio thresholds for sorting can be determined in a variety of ways. The thresholds can depend, for example on the nature of the lumber being sorted. For example, if green lumber needing to be dried is fairly homogenous or has a mostly uniform distribution of a mc/g ratio over some range of mc/g ratio, trial-and-error or other experimentation can be used to find a threshold that roughly splits the lumber into two equal sized categories. After sorting, each category can be kiln dried with different drying schedules to reduce the amount of over-dried or under-dried lumber. Multiple thresholds can also be determined to split the green lumber into more than two categories, for example if the range of uniform mc/g ratio is large enough, or if the variation of optimal drying time is large.

Alternately, if the green lumber to be dried is less homogenous, perhaps with a more bimodal distribution or otherwise lumpy distribution of either drying requirements or moisture content measures, a threshold can be set to split the lumps in the distribution. For example, in an area with a significant beetle infestation problem, the beetle-infested trees can have very different drying requirements than other trees of the same species and from the same geographic region. The distribution of drying requirements might tend to be bimodal, with a cluster of beetle-infested trees requiring a short drying time, and a cluster of non-infested trees requiring more drying time. Furthermore, the difference in drying requirements may correspond to a difference in moisture content ratio. Trial-and-error or other experimentation can determine a threshold that would separate the beetle-infested trees from the non-infested trees. The green lumber can then be sorted using that threshold, and each resultant category of green lumber can be dried using different drying processes or schedules. Such bimodal or lumpy distribution of mc/g ratio can of course occur for many reasons other than beetle infestations. A mc/g ratio threshold can be used in these other such cases to identify and split one distribution concentration from others.

Threshold selection methods can be combined. For example, if lumber from beetle-infested trees is combined with non-infested lumber having a wide mc/g ratio, then the distribution will be bimodal with a group of lumber at one end corresponding to the beetle infested lumber, and a second group at the other end over a wide range. In this case, one threshold might be found to separate the beetle-infested lumber from other lumber, and then one or more additional thresholds can be used to split the other group into two or more additional groups. This can optimize the drying times for the non-beetle infested group.

A combination of moisture content ratio and other factors can be used to sort or rate lumber. For example, sorting green lumber can be done based on both the size of the lumber and a moisture content ratio. Or a sort can be based on the moisture content ratio combined with species, sapwood/hardwood, and size groupings.

Moisture Content Ratio Results

Figure 3:
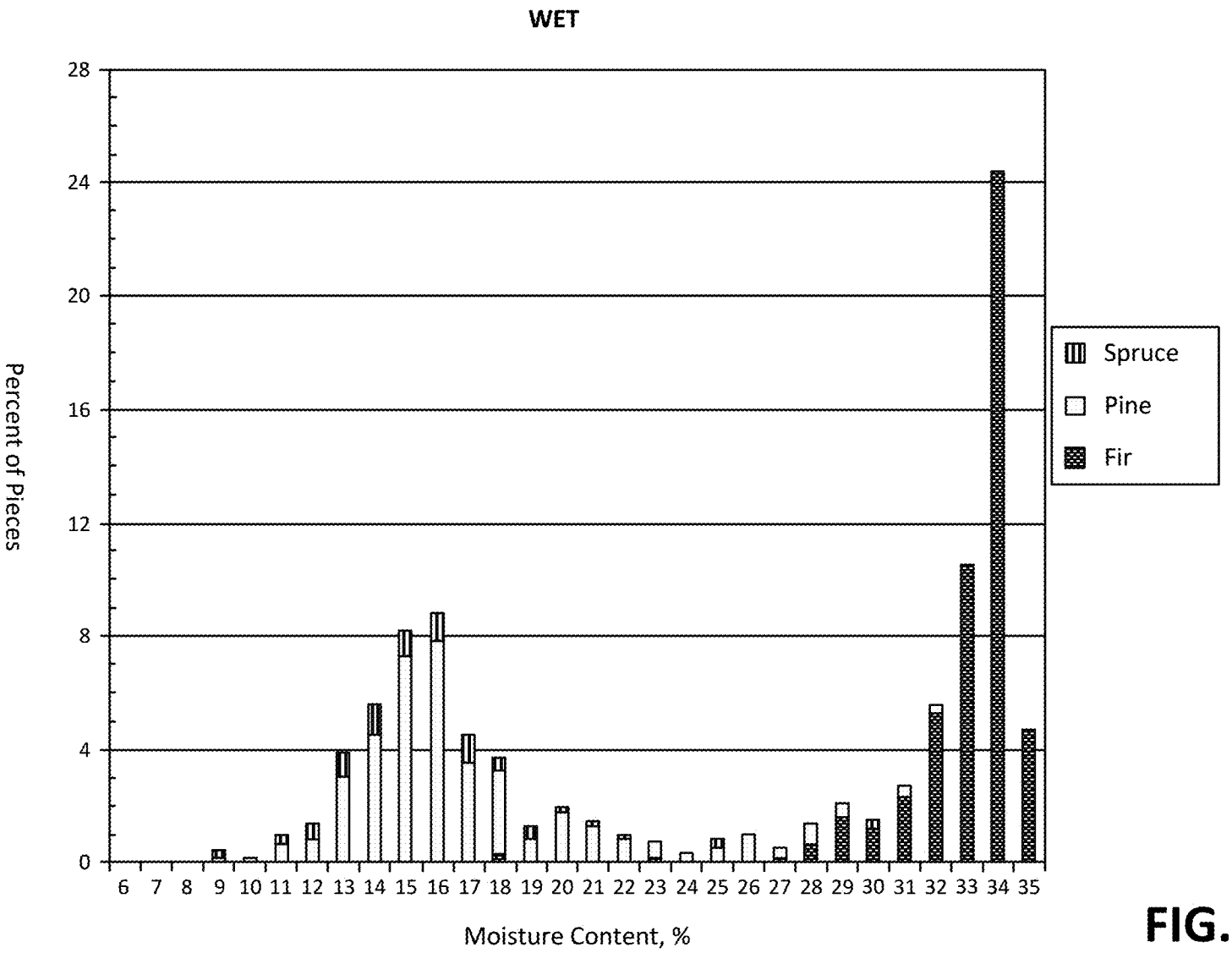
FIG. 3 is a graph depicting the distribution of moisture content of a wet sort after drying with a medium drying schedule.

An experiment was conducted to further refine the problem wet sort category from above, depicted in FIG. 2C, using a moisture content ratio. Green lumber, all 16' 2×4 boards (a dried and planed 2×4 board is generally 1.5"×3.5") was first sorted using only moisture content as measured by an NMI meter into dry, medium, and wet categories using thresholds as described above. The wet category included all boards with NMI reading above 48. All boards (including the wet sort) were then dried with the kiln schedule for the medium category. The resultant wet category boards were put thought a planer mill, tested for resultant moisture content, and the species of each board was determined. The results are in FIG. 3. Note again the bimodal moisture content distribution, with one peak frequency at 15% or 16% mc, and another peak at 34% mc. Very likely, the resultant moisture content for the sample set of wet sort boards might look much more like that of FIG. 2C if this group of wet sort boards had been dried with the wet sort drying schedule instead of the medium sort drying schedule.

Figure 4A:
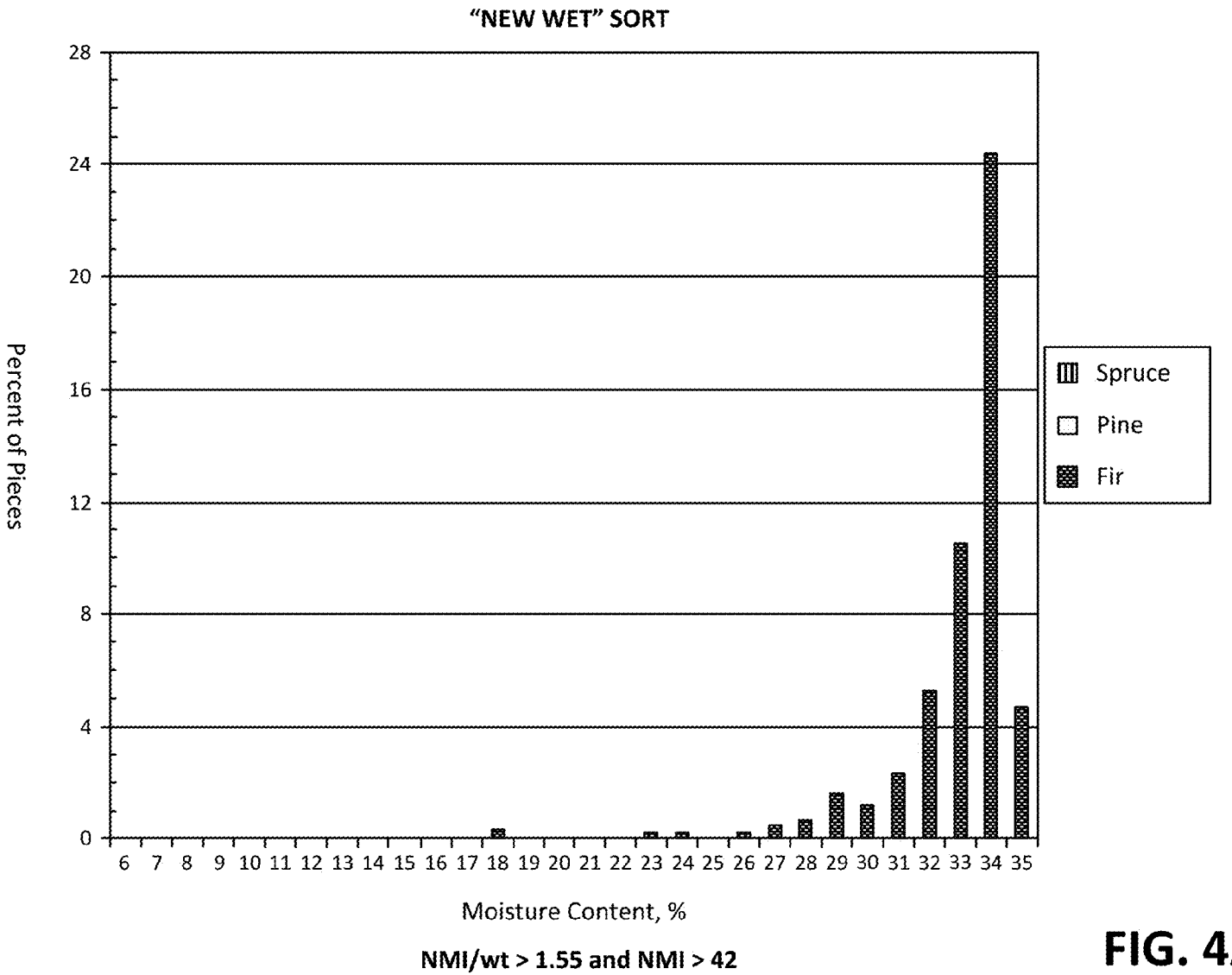
FIG. 4A is a graph depicting the distribution of moisture content of a "new wet" sort, further sorting the wet sort of FIG. 3 based on a moisture content ratio.
Figure 4B:
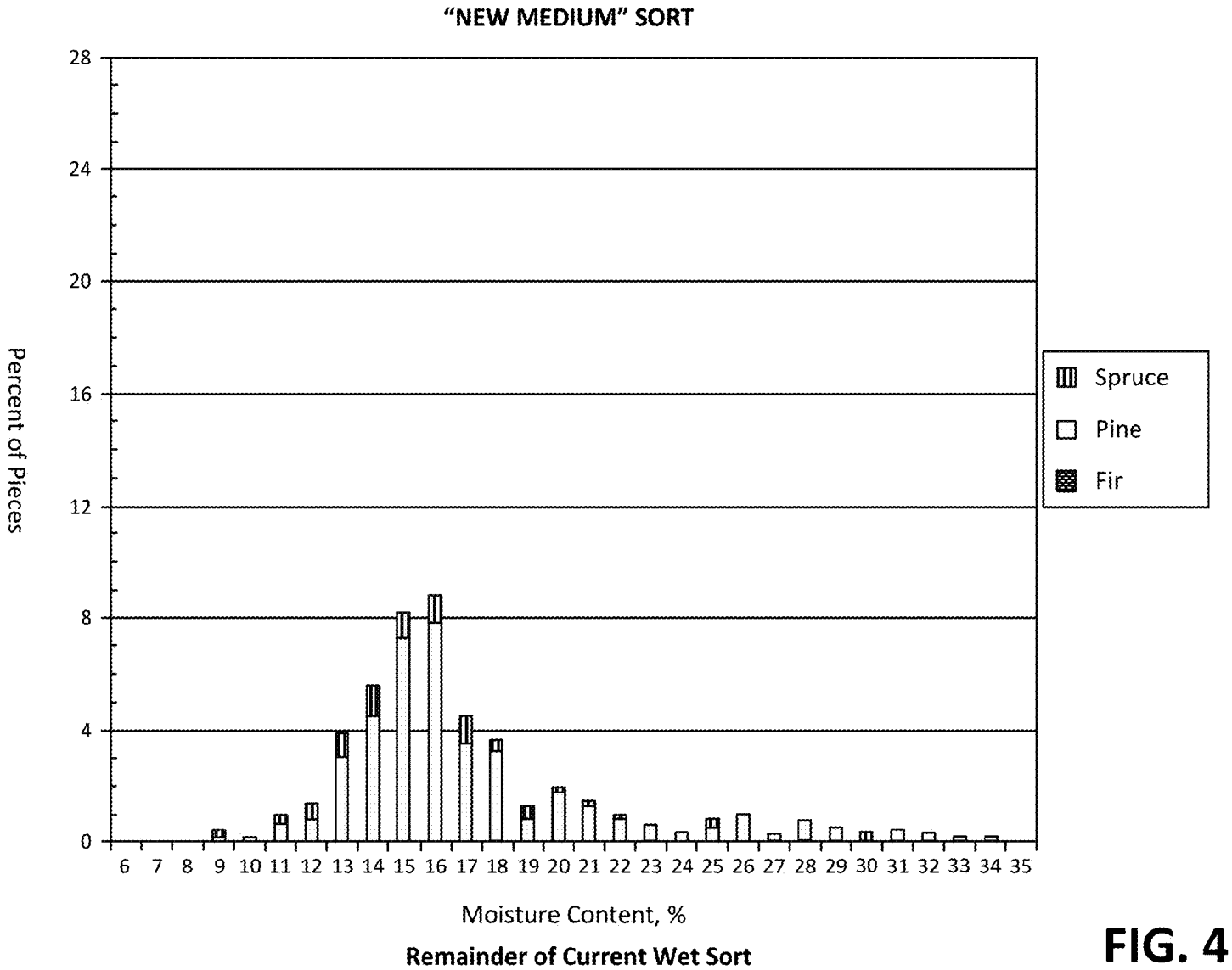
FIG. 4B is a graph depicting the distribution of moisture content of a "new medium" sort, further sorting the wet sort of FIG. 3 based on a moisture content ratio.

Then the problem category, the wet sort, was further sorted using an mc ratio threshold. The mc ratio used was NMI reading divided by the weight in pounds (NMI/lb). Note all boards were 16' 2×4s, and hence all board had similar volume, and hence a density-based mc ratio would have produce similar results. All boards with an NMI/lb rating above 1.55 were put in a "new wet" sort, an anything below that threshold were put in a "new medium" sort. The resulting moisture content distribution are depicted in FIG. 4A for the "new wet" sort and in FIG. 4B for the new medium sort. The improvement in sorting can be seen by comparing FIGS. 4A and 4B with the moisture content-only sort of FIG. 3. The boards in FIG. 4B were categorized as wet when using only moisture content, but they were well dried using the drying schedule for the medium category. Had the wet drying schedule been used on the "new medium" boards in FIG. 4B, they would likely have been over dried. Further, once the "new medium" board are removed, the remaining boards in the "new wet" sort can be further dried until they are largely within the target drying range of 10% to 15% mc.

Figure 5:
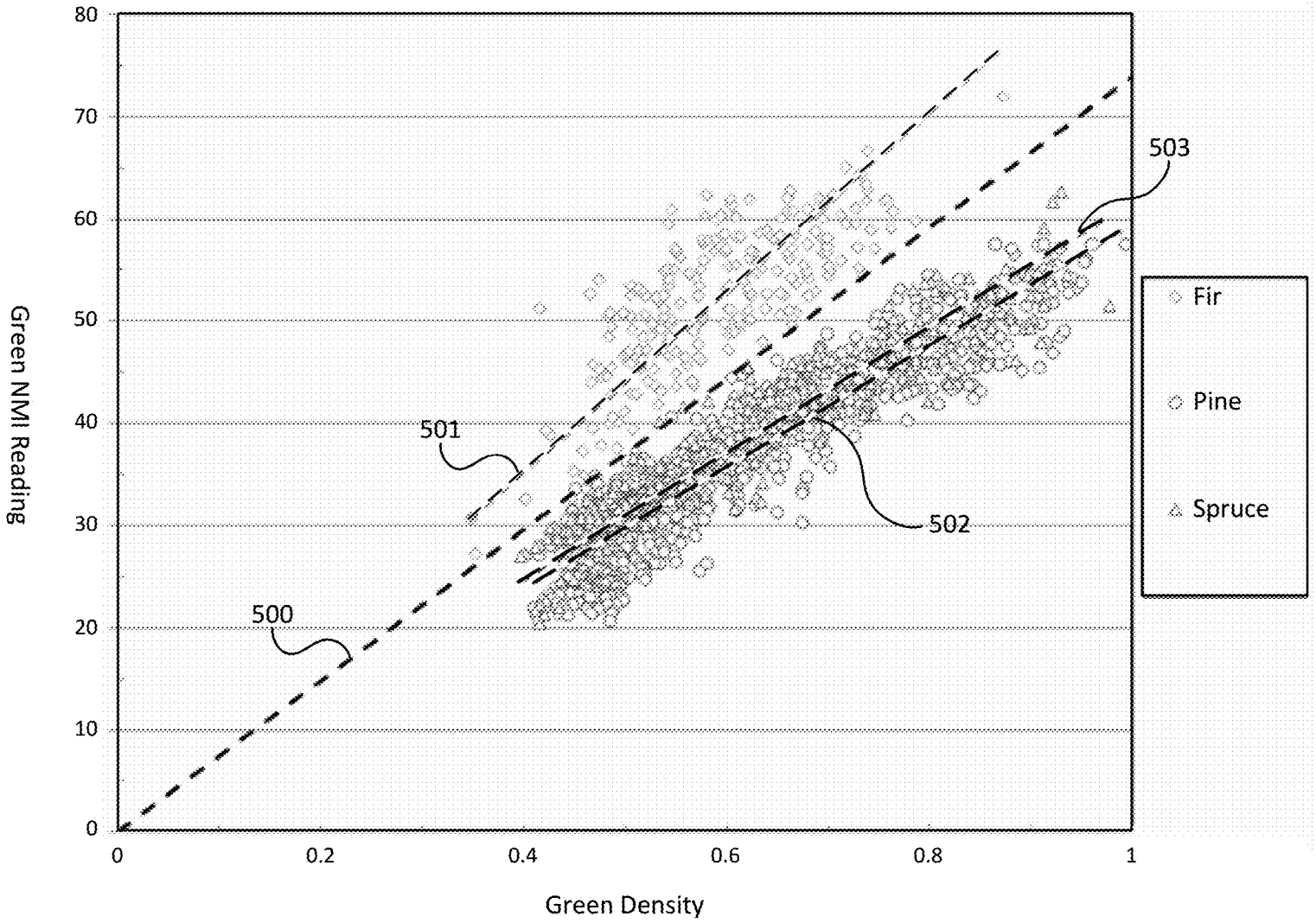
FIG. 5 is a graph depicting species separation by a density-based moisture content ratio.

Moisture content ratios can be used for species identification. Upon further experimentation with the "new wet" and "new medium" sorts above, it was determined that the problem green lumber was virtually all fir, and that the problem was not simply a matter of separating lumber based on moisture content. Separating the lumber based on species instead of moisture content is also effective. This time using a density-based moisture content ratio, a threshold NMI/(g/cc) of 74 almost perfectly separated the fir from the pine and spruce of in the sample of green lumber from Western Canada. FIG. 5 depicts species separation by density-based moisture content ratio. The vertical axis is the moisture content of each green board, as measured by an NMI meter. The horizontal axis is the density (specific gravity, g/cc) of each green board. Note that if every board sampled was the same size (say 16' 2×4s), then the horizontal axis could simply be a scaled version of board weight. The spots on the graph represent individual boards. Every diamond is a single fir board; every circle is a pine board; and every triangle is a spruce board. The dashed diagonal lines represent lines of constant NMI/(g/cc). Dashed line 501 is best fit to the fir boards and is a constant 87.9 NMI/(g/cc) slope. Dashed line 502 is the best fit for pine board with a 59.5 NMI/(g/cc) slope. Dashed line 503 is the best fit for spruce boards with 61.7 NMI/(g/cc) slope.

Threshold 500 is a constant 74 NMI/(g/cc). Careful inspection of FIG. 5 shows that virtually every fir board is above the 74 NMI/(g/cc) threshold, and virtually every pine and spruce board is below the threshold, making a sort based mc ratio effective to separate the fir from the other spruce and pine. As mentioned above, the goal when sorting green lumber for drying is to sort by required drying time (or drying schedule). The goal is not to sort simply by the amount of moisture in the lumber, because the drying rate also varies. This graph suggests that a sort based on an mc ratio may be more effective for sorting green lumber for drying because the mc ratio may more closely map to drying time than just moisture content or weight alone. Note that a sort on moisture content alone or density or weight alone will capture all three species. For example, using the upper threshold for wet sort in the experiment above, which was a 48 NMI reading, the threshold would be a horizontal line at 48, and all board above 48 would be sorted into the wet group. This wet group would include the bulk of the fir, though certainly not all of it, and the wet group would also include a large portion of the pine and spruce. Similarly, a sort based only on density (or weight for board of the same size) would correspond to a vertical line on the graph of FIG. 5. While boards of high moisture content will tend to require more kiln time to achieve a target moisture content level, a sort based only on moisture content will include different species and hence different drying rates. Grouping similar moisture content boards with different drying rates will not achieve the goal of a single drying time for the whole group to achieve the target dry moisture content level.

Modern lumber mills operate under relatively small profit margins, and even small increases in efficiency can produce significant savings and/or revenue. Likewise, small increases in efficiency may significantly reduce the amount of raw resources (e.g., trees), required to produce a given amount of lumber of particular grades and/or dimensions. In comparison to the $15-$20/MBF gain from sorting based on moisture content, sorting based on an mc ratio is expected to achieve a $20-$35/MBF gain.

Lumber Sorting System

Figure 6:
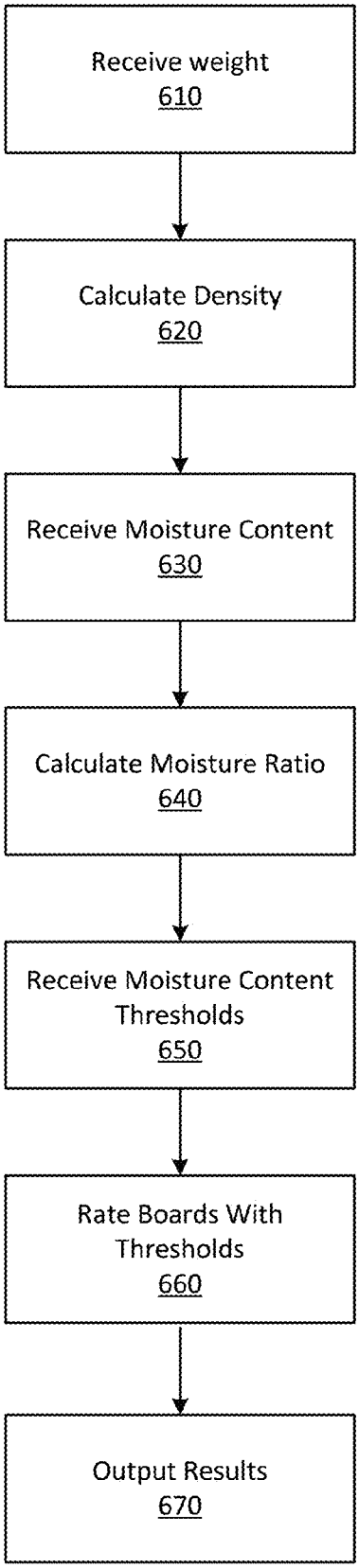
FIG. 6 depicts a lumber rating method.

FIG. 6 depicts an embodiment of a lumber rating method using a moisture content ratio, as it operates on a single board of lumber. As depicted in FIG. 6, the board weight is received 610. The source of the weight information may be delivered directly from a scale or mass measurement device, or may simply come from a storage having been previously measured or estimated. Density of the board can be calculated 620 from weight if a volume is known. Moisture content of the board is received 630 from a moisture content measurement device, or may come from a database where the previously measured moisture content of the board currently being rated was stored. The moisture content ratio is then calculated 640 for the board using the received moisture content and either the received weight or calculated density. In this embodiment, one or more moisture content thresholds are received 650, having been determined elsewhere. The boards are then assigned a rating 660 using the received thresholds, such that the rating identifies whether the board being above, below, or between the one or more received thresholds. The rating results are output 670 for use later, for example for use by the lumber movement system 740 of FIG. 7, as described below, or by a lumber drying system.

There are many possible alternate embodiments similar to the one depicted in FIG. 6. In a first alternate embodiment to FIG. 6, a density may be received, having been directly measured or calculated elsewhere. In this case a weight may not be received. In a second alternate embodiment, density is not used when the moisture content ratio is calculated directly from weight instead of density. In a third alternate embodiment, instead of receiving thresholds, the thresholds are calculated based on statistics of previous boards or other criteria, for example based on the range or distribution of moisture content ratios previously calculated. An example process for determining the thresholds would seek to produce roughly equal number of boards getting each rating, such that if ratings were used for determining drying schedule used, the number of boards using each drying schedule would be roughly equal. In this third embodiment, the thresholds may dynamically vary as more lumber is processed, and the drying schedules may also be adjusted dynamically as the thresholds are adjusted. In a fourth alternate embodiment, weight or moisture content are not received, but information is received that is used to calculate or otherwise derive a weight or moisture content measurement. In a fifth alternate embodiment, no thresholds are received or used, and the output ratings of each board is either the moisture content ratio itself, or a function of the moisture content ratio. Example functions of the moisture content ratio may include a scaling, a rounding, or a non-linear function of the moisture content ratio.

Figure 7:
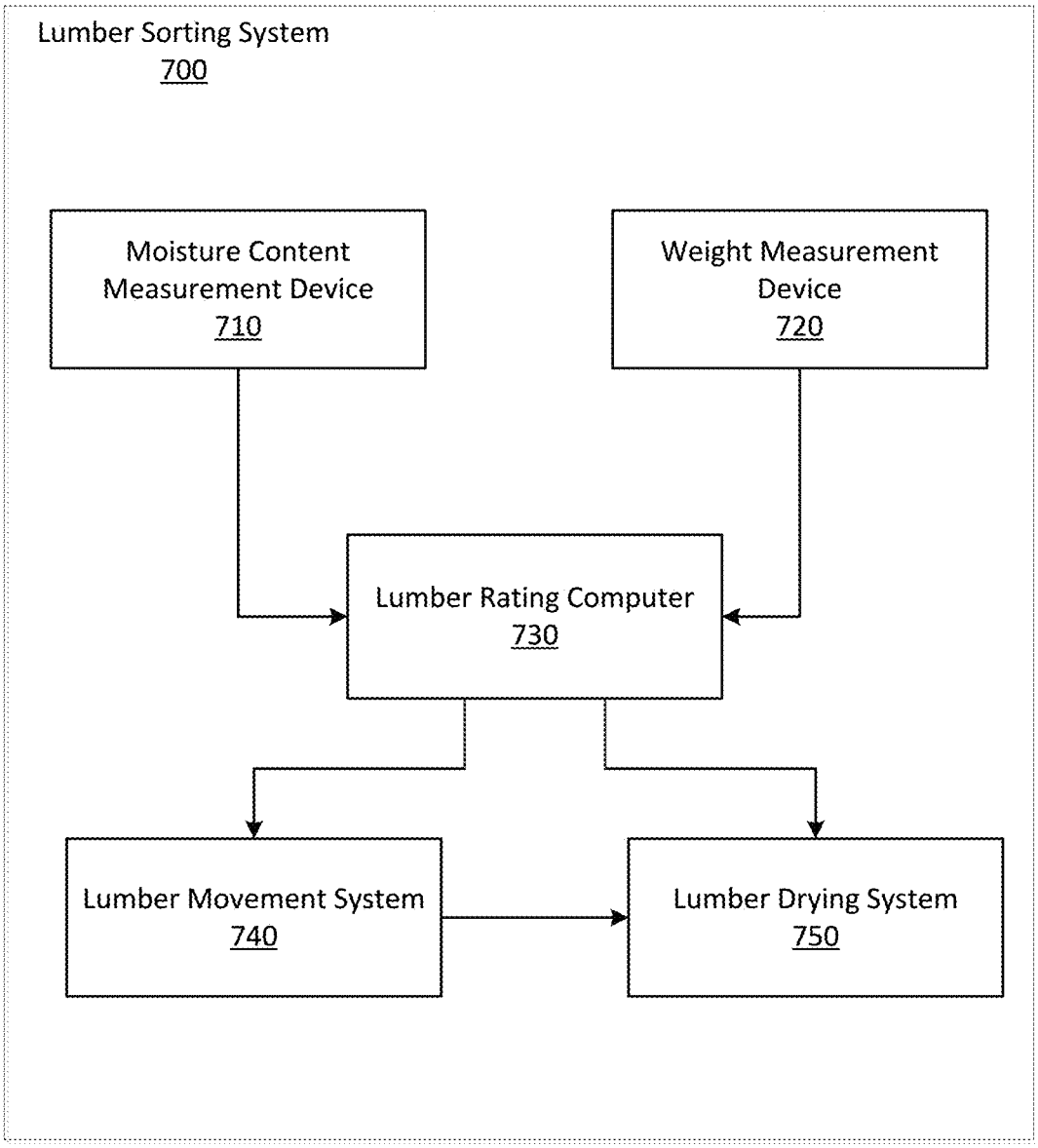
FIG. 7 depicts a lumber drying system.

FIG. 7 depicts a lumber drying system. A moisture content measurement device 710 and weight measurement device are communicatively coupled to a lumber rating computer 730. Moisture content measurement device 710 and weight measurement device 720 may be computers networked to the lumber rating computer 730, or they may be simple sensors operating as an input/output peripheral to the lumber rating computer 730. An example moisture measurement device 710 is the NMI brand moisture content meter described above. An example weight measurement device is a scale with a digital output. An example lumber rating computer is the computing system 800 of FIG. 8, described below, with software for performing the method of FIG. 6, described above. Lumber rating computer 730 may be any type of computing node or nodes, and the processes performed by it may be distributed across multiple computing nodes. The lumber rating computer 730 may produce a rating for a piece of lumber after it has received a moisture content measurement and a weight. The rating may be of many forms. For example, the rating may be simply a moisture content ratio, or, based on moisture content ratio thresholds, the rating may assign a board to one of a set of categories defined by the moisture content thresholds. Information related to this rating is provided to the lumber movement system 740, such that the physical location of the board at some point in the future is determined, at least in part, by the rating information sent to the lumber movement system. The lumber movement system 740 delivers lumber to a lumber drying system 750 that dries the lumber. The lumber drying system 750 may include a kiln and may dry the lumber based on the rating information determined by the lumber rating computer 730. The rating may be communicated directly to the lumber drying system 750 from the lumber rating computer 730, or indirectly via the lumber movement system 740. Accordingly, the communication or control path depicted in FIG. 7 between the lumber rating computer 730 and the lumber drying system 750 may or may not exist, and the communication or control path between the lumber movement system 740 and the lumber drying system 750 may or may not exist.

The lumber movement system 740 is any system capable of moving lumber. This may be part of an automated lumber production line, where, for example, individual boards are transported and processed on lugs, and where individual boards are diverted to different physical destinations for various purposes. Alternately, the lumber movement system may include a human. The lumber rating computer may present the rating to the human who physically picks up the board and puts the board in a location corresponding to the rating. In another implementation, the lumber sorting system may store or note the rating for use in determining a physical movement of the board.

The lumber drying system may include a batch kiln, where kiln packages are loaded, heated, and unloaded, and the lumber remains stationary in the kiln. However, the lumber drying system may also include a continuous drying kiln that is integrated with a lumber movement system. For example, one lumber movement system 740 may move individual boards and it may deposit lumber into bins according to a sorting decision made by the lumber rating computer 730. A second kiln lumber movement system may move kiln packages consisting of a lumber from a single bin. With a continuous drying kiln, the kiln packages move continuously or at regular small increments (for example, move 5 feet every 30 minutes) though a long kiln. Drying duration can be varied by varying the speed of the lumber movement system through the kiln (for example, move 5 feet every 40 minutes).

A primary example application of a lumber sorting system 700 is for sorting lumber for drying. In this case the lumber movement system may group board by the drying schedule they will use based on the rating related information provided to the lumber movement system from the lumber rating computer 730. An alternate example application of lumber sorting system 700 is for separating species based on a moisture content ratio.

Other sorting factors in addition to a moisture content ratio may be used by the lumber movement system. These additional factors may include log board quality, size, species of tree from which it was cut, or any other sorting factors, including those factors described above. The additional factors may be taken into account by the lumber movement system 740 and/or by the lumber rating computer 730. The lumber rating computer 730 may provide input to a lumber movement system 740 that is intelligent and complex, or the lumber rating computer may directly control the movement of boards via the lumber movement system 740. The lumber movement system 740 may also simply store the rating related information provided by the lumber rating computer 730 for later use, for example much further down an automated lumber processing line. In embodiments of lumber sorting system 700 where the lumber rating computer 730 take other sorting factors into account, there may be additional elements not depicted in FIG. 7 that provide the additional sorting factors as input to the lumber rating computer 730.

While arrows between the elements of FIG. 7 indicate the general flow of information or control, two way communication is possible in some embodiments. For example, the Lumber rating system may poll either the moisture content measuring device 710 or the weight measurement device 720 when it is ready for a new moisture content or weight measurement. Or, for example, the lumber movement system 740 may notify the lumber rating computer 730 when movement of a board has completed.

Figure 8:
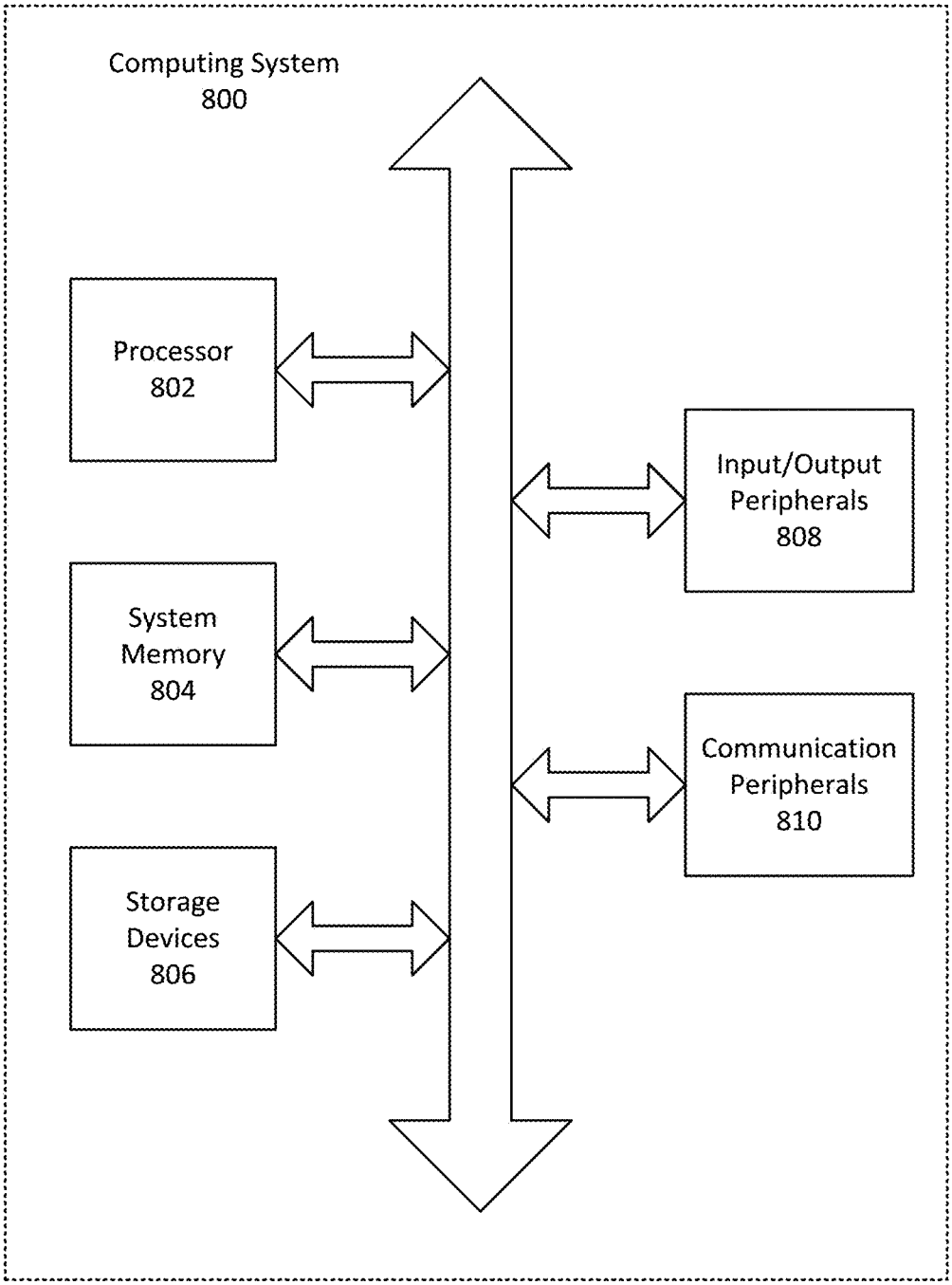
FIG. 8 depicts a general computing system.

FIG. 8 depicts a general computing system 800. As described above, the operations associated with a lumber sorting system 700 may be distributed across various components that include the moisture content measuring device 710, the weight measurement device 720, the lumber rating computer 730, and the lumber sorting system 740. These various components may be implemented on a wide variety of computing environments similar to computing system 800, such as commodity-hardware computers, virtual machines, computing clusters and computing appliances, cloud computing, and programmable logic controllers (PLCs). Any of these computing devices or environments may be referred to as computing nodes or systems. Moisture content measuring device 710, the weight measurement device 720, the lumber rating computer 730, the lumber sorting system 740, and the lumber drying system 750 may be implemented all as separate computers, or as input/output peripherals on a single computer, or as some combination of these two options.

In a basic configuration, the computing device may include at least a processor 802, a system memory 804, storage devices 806, input/output peripherals 808, communication peripherals 810, and an interface bus connecting these various components. The interface bus is configured to communicate, transmit, and transfer data, controls, and commands between the various components of the computing device. The system memory and the storage device comprise computer readable storage media, such as RAM, ROM, EEPROM, hard-drives, CD-ROMs, optical storage devices, magnetic storage devices, flash memory, and other tangible storage media. Any of such computer readable storage medium can be configured to store instructions or program codes embodying aspects of the disclosure. Additionally, the system memory comprises an operation system and applications. The processor is configured to execute the stored instructions and can comprise, for example, a logical processing unit, a microprocessor, a digital signal processor, and the like.

The input/output peripherals 808 include user interfaces, such as a keyboard, screen, microphone, speaker, touch-screen interface, other input/output devices, and computing components—such as digital-to-analog and analog-to-digital converters, graphical processing units, serial ports, parallel ports, universal serial bus, transmitter, receiver, etc. The input/output peripherals 808 may be connected to the processor through any of the ports coupled to the interface bus. Input/output peripherals 808 may enable input or output from devices such as the moisture content measurement device 710, weight measurement device 720, and lumber sorting system 740 of FIG. 7.

Finally, the communication peripherals 810 of the computing device are configured to facilitate communication between the computing device and other computing devices (e.g., between the computing device and the server) over a communications network. The communication peripherals include, for example, a network interface controller, modem, various modulators/demodulators and encoders/decoders, wireless and wired interface cards, antenna, etc. Communication peripherals 810 may enable network communications with computers or services, such as the moisture content measurement device 710, weight measurement device 720, and lumber sorting system 740 of FIG. 7.

The communication network includes a network of any type that is suitable for providing communications between the computing device and the server, and may comprise a combination of discrete networks, which may use different technologies. For example, the communications network includes a cellular network, a Wi-Fi/broadband network, a local area network (LAN), a wide area network (WAN), a telephony network, a fiber-optic network, or combinations thereof. In an example embodiment, the communication network includes the Internet and any networks adapted to communicate with the Internet. The communications network may be also be configured as a means for transmitting data between the computing device and the server.

By way of example, computer instructions for implementing part or all of a lumber rating or sorting system can be stored in either system memory 804 or storage devices 806. Actions of the lumber rating computer 730 may be performed when processor 802 executes the instructions stored in system memory 804. Communication between the lumber sorting system 700 and other computing nodes providing input to, or consuming output from, the lumber rating computer may be facilitated through communications peripherals 810 or as input/output peripherals 808.

The techniques described above may be embodied in, and fully or partially automated by, code modules executed by one or more computers or computer processors. The code modules may be stored on any type of non-transitory computer-readable medium or computer storage device, such as hard drives, solid state memory, optical disc, and/or the like. The processes and algorithms may be implemented partially or wholly in application-specific circuitry. The results of the disclosed processes and process steps, including creation of or changes to a billing services account, may be stored, persistently or otherwise, in any type of non-transitory computer storage such as, e.g., volatile or non-volatile storage.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed:

1. A method for drying a piece of lumber, comprising:

receiving at a device information indicative of a moisture content of a piece of lumber;

receiving at the device information indicative of a density of the piece of lumber;

determining on the device a ratio of the received moisture content to the received density;

receiving at the device information indicative of at least two wood drying schedules;

determining on the device an assignment for the piece of lumber to one of the at least two wood drying schedules based at least in part on the ratio;

sending to a lumber drying system information related to the assignment; and drying the piece of lumber in the lumber drying system in accordance with the assignment.

2. The method of claim 1, further comprising:

determining a relationship between the ratio and one or more thresholds of the ratio, wherein the determining on the device the assignment for the piece of lumber is based at least in part on the relationship.

3. The method of claim 1, wherein determining on the device a ratio of the received moisture content to the received density comprises determining the ratio by dividing moisture content by weight or by dividing weight by moisture content.

4. The method of claim 1, further comprising:

receiving at the device information indicative of a size of the piece of lumber; and wherein determining on the device the assignment for the piece of lumber to a drying schedule comprises determining on the device the assignment for the piece of lumber to a drying schedule based at least in part on the ratio and information indicative of the size of the piece of lumber.

5. The method of claim 1, further comprising:

sending to a lumber movement system information indicative of the assignment:, and moving the piece of lumber via the lumber movement system to a location determined at least in part on the assignment.

6. The method of claim 1, further comprising;

sending to a kiln information related to the assigned drying schedule.

7. The method of claim 1, further comprising:

determining the information indicative of a density of the piece of lumber based at least in part on a volume and a weight of the piece of lumber.

* * * * *